US009625154B2

(12) United States Patent
Benz et al.

(10) Patent No.: US 9,625,154 B2
(45) Date of Patent: Apr. 18, 2017

(54) DAMPER FOR GAS TURBINES

(71) Applicant: ALSTOM Technology Ltd, Baden (CH)

(72) Inventors: Urs Benz, Gipf-Oberfrick (CH); Nicolas Noiray, Bern (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 390 days.

(21) Appl. No.: 14/279,888

(22) Filed: May 16, 2014

(65) Prior Publication Data

US 2014/0345285 A1 Nov. 27, 2014

(30) Foreign Application Priority Data

May 24, 2013 (EP) ..... 13169211

(51) Int. Cl.

| | |
|---|---|
| ***F02C 7/24*** | (2006.01) |
| ***F23R 3/16*** | (2006.01) |
| ***F23R 3/00*** | (2006.01) |
| ***F23R 3/60*** | (2006.01) |
| ***F23M 20/00*** | (2014.01) |

(52) U.S. Cl.

CPC ..... *F23R 3/16* (2013.01); *F23M 20/005* (2015.01); *F23R 3/002* (2013.01); *F23R 3/60* (2013.01); *F23M 2900/05002* (2013.01); *F23R 2900/00005* (2013.01); *F23R 2900/00014* (2013.01)

(58) Field of Classification Search

CPC .... F23R 2900/00014; F23R 2900/0001; F23D 2210/00; F05B 2260/96

See application file for complete search history.

(56) References Cited

U.S. PATENT DOCUMENTS

| | | | | |
|---|---|---|---|---|
| 3,063,438 A * | 11/1962 | Bodine, Jr. | ..... | F02B 23/08 123/660 |
| 3,620,013 A * | 11/1971 | Rogers | ..... | F23N 5/16 431/114 |
| 5,373,695 A | 12/1994 | Aigner et al. | | |
| 5,584,447 A | 12/1996 | Pla | | |

(Continued)

FOREIGN PATENT DOCUMENTS

| | | |
|---|---|---|
| CN | 102679396 A | 9/2012 |
| CN | 102954495 A | 3/2013 |

(Continued)

*Primary Examiner* — Derek Battisti

(74) *Attorney, Agent, or Firm* — Buchanan Ingersoll & Rooney PC

(57) ABSTRACT

The invention relates to a damper for reducing the pulsations in a combustion chamber of a gas turbine. The damper includes a resonator cavity with an inlet and a neck tube in flow communication with the interior of the combustion chamber and resonator cavity, and a compensation assembly pivotably connected with the neck tube. The compensation assembly is inserted between the resonator cavity and the combustion chamber to permit relative rotation between the combustion chamber and the resonator cavity. With the damper according to the present invention, by way of providing the compensation assembly, it is assured the relative rotation between the combustion chamber and the resonator cavity is compensated, hence operation life is elongated.

10 Claims, 1 Drawing Sheet

(56) References Cited

U.S. PATENT DOCUMENTS

| | | | | |
|---|---|---|---|---|
| 7,857,094 | B2 * | 12/2010 | Macquisten | F23R 3/002 181/250 |
| 2004/0248053 | A1 | 12/2004 | Benz et al. | |
| 2006/0123791 | A1 * | 6/2006 | Macquisten | F23M 20/005 60/725 |
| 2008/0216481 | A1 * | 9/2008 | Pollarolo | F23R 3/50 60/725 |
| 2011/0308630 | A1 * | 12/2011 | Huber | F23M 20/005 137/14 |
| 2012/0102963 | A1 * | 5/2012 | Corr | F23R 3/002 60/772 |
| 2012/0228050 | A1 * | 9/2012 | Bulat | F01N 1/023 181/213 |

FOREIGN PATENT DOCUMENTS

| | | |
|---|---|---|
| EP | 1 424 469 | 6/2004 |
| RU | 2380618 C2 | 1/2010 |
| WO | 2005/059441 | 6/2005 |
| WO | 2012/057994 | 5/2012 |

* cited by examiner

DAMPER FOR GAS TURBINES

CROSS-REFERENCE TO RELATED APPLICATIONS

This application claims priority to European application 13169211.3 filed May 24, 2013 the contents of which are hereby incorporated in its entirety.

TECHNICAL FIELD

The present invention relates to a gas turbine, more particular, to a damper for reducing the pulsations in a combustion chamber of a gas turbine.

BACKGROUND

In conventional gas turbines, acoustic oscillation usually occurs in the combustion chamber of the gas turbines during combustion process due to combustion instability and varieties. This acoustic oscillation may evolve into highly pronounced resonance. Such oscillation, which is also known as combustion chamber pulsations, can assume amplitudes and associated pressure fluctuations that subject the combustion chamber itself to severe mechanical loads that my decisively reduce the life of the combustion chamber and, in the worst case, may even lead to destruction of the combustion chamber.

Generally, a type of damper known as Helmholtz damper is utilized to damp the pulsations generated in the combustion chamber of the gas turbine. Currently, one of the main difficulties in utilization of such damper is the fact that the space available for these dampers is limited. One possible approach in addressing such situation is to place the damper on the outer side of the combustion chamber. In practice, the thermal expansion of the different layers composing the combustion chamber prevents directly applying such dampers.

A damping arrangement for reducing resonant vibrations in a combustion chamber of a gas turbine is disclosed in US2004/0248053A1, wherein the combustion chamber comprises an outer wall-surface part and an inner wall-surface part facing the combustion chamber, gastightly encloses an intermediate space, into which cooling air can be fed for purposes of convective cooling of the combustion chamber wall. At least one third wall-surface part is provided, which, with the outer wall-surface part, encloses a gastight volume. The gastight volume is connected gastightly to the combustion chamber by at least one connecting line. A gasket is welded at an end of the connecting line that is located in the gastight volume, and covers the outer wall surface part to provide gas tightness. With this gasket and connecting lines, the damping arrangement may compensate thermal expansion difference between the outer and inner wall-surface part in one direction.

A combustion chamber suitable for a gas turbine engine is provided in US2006/0123791A1, which comprise at least one Helmholtz resonator having a resonator cavity and a resonator neck in flow communication with the chamber interior. The Helmholtz resonator is fixed to an inner casing of the combustion chamber, with the resonator neck penetrating into the interior of the combustion chamber through an opening on the inner wall of the combustion chamber. An annular sealing member is provided around the outer periphery of the neck to provide gas tight seal between the neck and the opening. The neck provides limited relative axial movement of the neck with respect to the combustion chamber so that substantially no load is transferred from the resonator neck to the combustion chamber during engine operation.

A combustor for a gas turbine including at least one resonator is disclosed in WO2012/057994A2, which comprises an outer liner and an inner liner. The resonator is coupled to the outer liner. The combustor liner includes a throat extending from the base of the resonator penetrating into the combustion chamber through the inner liner and the outer liner. The combustor liner further includes a grommet assembly that allows for relative thermal expansion between the inner liner and the outer liner proximate the throat in a first direction along the axis of the throat and a second direction perpendicular to the first direction.

Even with above mentioned development in the pulsation damping field, there exist a large space to improve the compensation effect in eliminating thermal expansion difference.

SUMMARY

It is an object of the present invention is to provide a damper for a gas turbine that may compensate relative rotation generated between the combustor chamber and the damper, in particular, the resonator cavity of the damper, due to thermal expansion difference.

This object is obtained by a damper for reducing the pulsations in a combustion chamber of a gas turbine, wherein the damper comprises: a resonator cavity with an inlet and a neck tube in flow communication with the interior of the combustion chamber and resonator cavity, and a compensation assembly pivotably connected with the neck tube and is inserted between the resonator cavity and the combustion chamber to permit relative rotation between the combustion chamber and the resonator cavity.

According to one possible embodiment, the neck tube is air-tightly attached at a first end thereof to a wall of the combustion chamber, the compensation assembly is pivotably connected with a second end of the tube neck, wherein the compensation assembly comprises a bulb portion formed on the second end of the neck tube and a socket portion air-tightly fitted with the bulb portion to provide the relative rotation between the combustion chamber and the resonator cavity. According to another one possible embodiment, the compensation assembly further comprises a first sliding part formed on the socket portion and a second sliding part air-tightly fitted with the first sliding part to provide relative slide along a direction parallel to a longitudinal axis of the neck tube between the first sliding part and the second sliding part.

According to another one possible embodiment, the compensation assembly further comprises a third sliding part formed on the second sliding part and a fourth sliding part formed on the inlet of the resonator cavity that is air-tightly fitted with the third sliding part to provide relative slide in a direction traversing the longitudinal axis of the neck tube between the third sliding part and the fourth sliding part.

According to another one possible embodiment, the wall of the combustion chamber comprises an outer wall and an inner wall located radially inwards than the outer wall, and the neck tube is air-tightly attached at the first end thereof to the inner wall of the combustion chamber, and passing through an opening on the outer wall with a grommet air-tightly attached to a peripheral of the neck tube in order to cover the opening on the outer wall.

According to another one possible embodiment, the third sliding part comprises a protrusion formed thereon where the protrusion is allowed to air-tightly slide against the fourth sliding part.

According to another one possible embodiment, the neck tube is air-tightly attached at a first end thereof to the inlet of the resonator cavity, the compensation assembly is pivotably connected with a second end of the tube neck, wherein the compensation assembly comprises a bulb portion formed on the second end of the tube neck and a socket portion air-tightly fitted with the bulb portion to provide the relative rotation between the combustion chamber and the resonator cavity.

According to another one possible embodiment, the compensation assembly further comprises a first sliding part formed on the socket portion and a second sliding part air-tightly fitted with the first sliding part to provide relative slide along a direction parallel to a longitudinal axis of the neck tube between the first sliding part and the second sliding part.

According to another one possible embodiment, the compensation assembly further comprises a third sliding part formed on the second sliding part and a fourth sliding part formed on the wall of the combustion chamber that is air-tightly fitted with the third sliding part to provide relative slide in a direction traversing the longitudinal axis of the neck tube between the third sliding part and the fourth sliding part.

According to another one possible embodiment, the third sliding part comprises a protrusion formed thereon where the protrusion is allowed to air-tightly slide against the fourth sliding part.

With the damper according to the present invention, by way of providing the compensation assembly, it is assured the relative rotation between the combustion chamber and the resonator cavity is compensated, hence operation life is elongated.

BRIEF DESCRIPTION OF THE DRAWINGS

The objects, advantages and other features of the present invention will become more apparent upon reading of the following non-restrictive description of preferred embodiments thereof, given for the purpose of exemplification only, with reference to the accompany drawing, through which similar reference numerals may be used to refer to similar elements, and in which.

DETAILED DESCRIPTION

Figure 1:
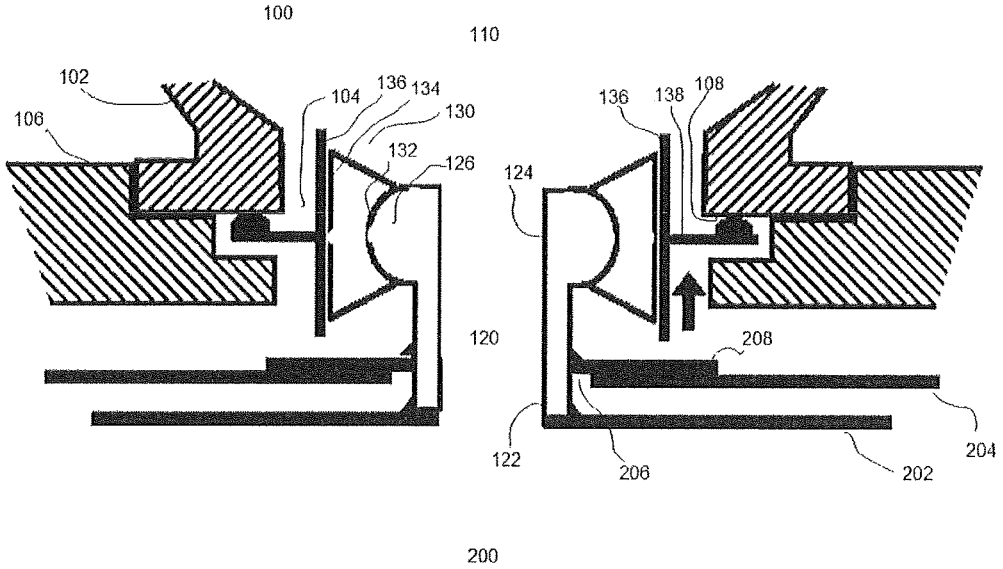
FIG. 1 shows a schematic cross section view of the damper with part of the combustion chamber of a gas turbine according to one embodiment of the present invention, in which some part is cut way for the purpose of clarity.

FIG. 1 shows a schematic cross section view of a damper 100 with part of the combustion chamber 200 of a gas turbine according to an embodiment of the present invention, in which some part is cut way for the purpose of clarity. The damper 100 comprises a resonator cavity 110 with a box or cylinder shape as delimitated by a peripheral wall 102 and an inlet 104. As shown in FIG. 1, the major part of the resonator cavity 110 is cut away as this would not prevent full and complete understanding of the technical solutions of the present invention. Also, only parts of the combustion chamber 200 closely related to the present invention is shown in FIG. 1 for clarity and simplicity. The resonator cavity 110 is air tightly attached to a structure 106 of a combustion chamber 200 by fasteners, not shown in FIG. 1. In an example implementation of the present invention, the structure 106 of the combustion chamber 200 may be a casing of the combustion chamber 200. Those skilled in the art should appreciate that the structure 106 provides carrier for the resonator cavity 110, and should not be limited to the casing of the combustion chamber as described herein. In addition, the damper 100 comprises a neck tube 120 that is in flow communication with the resonator cavity 110 through a compensation assembly 130 according to the present invention in order to compensate relative movement between the resonator cavity 110 and the combustion chamber 200.

According to one example embodiment, the neck tube 120 is air tightly attached at a first end 122 thereof to the wall of the combustion chamber 200. For example, the first end 122 of the neck tube 120 may be welded to the wall of the combustion chamber 200. As one possible implementation that may be applied in a double wall combustion chamber where the combustion chamber 200 comprises an inner wall 202 and an outer wall 204 radially located outward than the inner wall 202, the first end 122 of the neck tube 120 may be air tightly attached to the inner wall 202 of the combustion chamber 200, with the neck tube 120 extending through an opening 206 on the outer wall 204. In this case, a grommet 208 may be air tightly attached, such as welded, to a peripheral of the neck tube 120 in order to cover the gap generated between the neck tube 120 and the opening 206, providing air tightness.

As an alternative embodiment, the grommet 208 may be dispensed when the present invention is applied in a single wall combustion chamber.

According to one example embodiment of the present invention, the compensation assembly 130 may pivotably connected with the neck tube 120 and is inserted between the resonator cavity 110 and the combustion chamber 200 to permit relative rotation between the combustion chamber 200 and the resonator cavity 110. In this embodiment, the compensation assembly 130 may be pivotably connected with a second end 124 opposite to the first end 122 of the tube neck 120. In particular, the compensation assembly 130 may comprise a bulb portion 126 formed on the second end 124 and a socket portion 132 air-tightly fitted with the bulb portion 126 to provide the relative rotation between the combustion chamber 200 and the resonator cavity 110. During operation of the gas turbine, the relative rotation between the combustion chamber 200 and the resonator cavity 110 due to different thermal expansion may be compensated or absorbed by the compensation assembly 130, so as to prevent potentially structural damage.

In addition, the compensation assembly 130 may comprise a first sliding part 134 formed on the socket portion 132 on a opposite side therefrom, and a second sliding part 136 air-tightly fitted with the first sliding part 134 to provide relative slide along a direction parallel to a longitudinal axis of the neck tube 120 between the first sliding part 134 and the second sliding part 136. During operation of the gas turbine, the relative slide between the first sliding part and the second sliding part may compensate the relative movement along the longitudinal axis of the neck tube 120 between the combustion chamber 200 and the resonator cavity 110 due to different thermal expansion.

Furthermore, the compensation assembly 130 my comprise a third sliding part 138 formed on the second sliding part 136 opposite to the first sliding part 134 and a fourth sliding part 108 formed on the inlet 104 of the resonator cavity 110 that is air-tightly fitted with the third sliding part 138 to provide relative slide in a direction traversing the longitudinal axis of the neck tube 122 between the third sliding part 138 and the fourth sliding part 108. During operation of the gas turbine, the relative slide between the third sliding part 138 and the fourth sliding part 108 may compensate the relative movement in a direction traversing the longitudinal axis of the neck tube 120 between the combustion chamber 200 and the resonator cavity 110 due to different thermal expansion.

As shown in FIG. 1, the fourth sliding part 108 may be provided by an end face of the inlet 104, which may represent one possible solution that may be adopted by those skilled in the art. However, equivalent structures may be utilized as the fourth sliding part 108. For example, when the resonator cavity 110 is attached by means of an intermediate component, such as a plate with opening to adjust the size and dimension of the inlet 104, not shown, to the structure 106 of the combustion chamber 200, the fourth sliding part 108 may be provided by the plate. As another example, even a portion of the structure 106 of the combustion chamber 200 may be used to provide the fourth sliding part 108, provided the structure 106 is specifically shaped to provide a recess below the inlet 104 against which the third sliding part 138 may slide.

As one possible implementation, the resonator cavity 110 may be a cylinder shape with a circular inlet 104. In this case, the circular inlet 104 comprises a flange disposed therearound, by which the resonator cavity 110 is attached to a casing of the combustion chamber 200. In this implementation, the bulb portion 126 may be formed around the second end 124 of the neck tube 120 with a pipe shape sized to adapt certain applications. The socket portion 132 and the first sliding part 134 of the compensation assembly 130 may be provided by a ring with certain width and thickness, where the socket portion 132 will be formed as a circular groove on the inner peripheral surface in the ring, and the first sliding part 134 will be the outer peripheral surface of the ring. In this case, FIG. 1 may represent a cross section view of the compensation assembly 130. The second sliding part 136 of the compensation assembly 130 may be provided by a sleeve with an inner diameter to air tightly fitted with the outer diameter of the ring in order to provide the relative slide between the ring and the sleeve. Further, the third sliding part 138 may be provided by a circular plate with a protrusion at a peripheral thereof. The circular plate may be integrated with the sleeve. The protrusion of the circular plate may be allowed to air tightly slide against an end face of the flange as the fourth sliding part in order to provide relative slide between the circular plate and the resonator cavity. Those skilled in the art should appreciate that, the above implementation intends to be one example only, and should not be interpreted as any limitation to the scope and application of the present invention. In accordance with teaching in the present disclosure, those skilled in the art may adapt the present invention to different applications where the shapes, dimensions and structures of the resonator cavity, compensation assembly and neck tube may be different, all of which should be considered to fall into the protection scope of the present invention.

Figure 2:
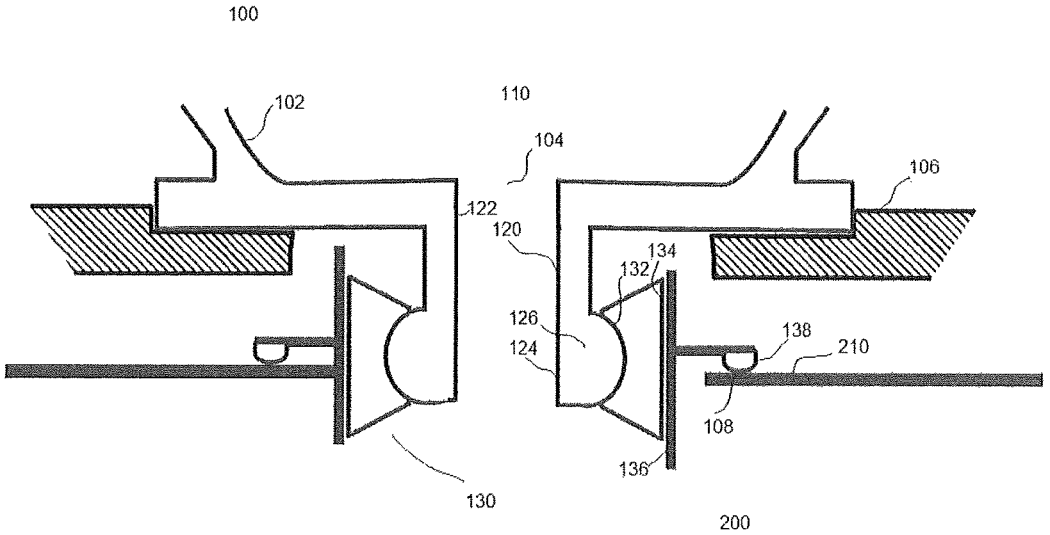
FIG. 2 shows a schematic cross section view of the damper with part of the combustion chamber of a gas turbine according to another embodiment of the present invention, in which some part is cut way for the purpose of clarity.

According to another example embodiment, as shown in FIG. 2, a cut-away schematic cross section view of a damper 100 according to the present invention is provided. The damper 100 comprises a resonator cavity 110 with a box or cylinder shape as delimitated by a peripheral wall 102 and an inlet 104. The resonator cavity 110 is air tightly attached to a structure 106 of a combustion chamber 200 by fasteners, not shown in FIG. 2. In an example implementation of the present invention, the structure 106 of the combustion chamber 200 may be a casing of the combustion chamber 200. Those skilled in the art should appreciate that the structure 106 provides carrier for the resonator cavity 110, and should not be limited to the casing of the combustion chamber as described herein. In addition, the damper 100 comprises a neck tube 120 that is in flow communication with the resonator cavity 110 through a compensation assembly 130 according to the present invention in order to compensate relative movement between the resonator cavity 110 and the combustion chamber 200. As an embodiment shown in FIG. 2, the neck tube 120 is air tightly attached at a first end 122 to the inlet 104 of the resonator cavity 110. For example, the first end 122 of the neck tube 120 is integrated with the inlet 104 of the resonator cavity 110. As another example, the first end 122 of the neck tube 120 may be welded with the inlet 104 of the resonator cavity 110. In this embodiment, the compensation assembly 130 is pivotably connected with a second end 124 of the neck tube 120.

According to one example embodiment of the present invention, the compensation assembly 130 may comprises rotation compensation structures. In particular, the compensation assembly 130 may comprise a bulb portion 126 formed on a second end 124 opposite to the first end 122 of the neck tube 120 and a socket portion 132 air-tightly fitted with the bulb portion 126 to provide the relative rotation between the combustion chamber 200 and the resonator cavity 110. During operation of the gas turbine, the relative rotation between the combustion chamber 200 and the resonator cavity 110 due to different thermal expansion may be compensated or absorbed by the compensation assembly 130, so as to prevent potentially structural damage.

In addition, the compensation assembly 130 may comprise a first sliding part 134 formed on the socket portion 132 on a opposite side therefrom, and a second sliding part 136 air-tightly fitted with the first sliding part 134 to provide relative slide along a direction parallel to a longitudinal axis of the neck tube 120 between the first sliding part 134 and the second sliding part 136. During operation of the gas turbine, the relative slide between the first sliding part and the second sliding part may compensate the relative movement along the longitudinal axis of the neck tube 120 between the combustion chamber 200 and the resonator cavity 110 due to different thermal expansion.

Furthermore, the compensation assembly 130 my comprise a third sliding part 138 formed on the second sliding part 136 opposite to the first sliding part 134 and a fourth sliding part 108 formed on the wall 210 of the combustion chamber 200 that is air-tightly fitted with the third sliding part 138 to provide relative slide in a direction traversing the longitudinal axis of the neck tube 122 between the third sliding part 138 and the fourth sliding part 108. As shown in FIG. 2, the fourth sliding part 108 is provided by a surface of the wall 210 of the combustion chamber 200.

It should be noticed that, in particular application where relative rotation between the combustion chamber and the resonator cavity is significant and relative movement between them along the longitudinal axis of the neck tube and along a perpendicular direction traversing the longitudinal axis of the neck tube is negligible, the first and second sliding parts of the compensation assembly may be integrally formed, and the third and fourth sliding parts of the compensation assembly may be integrally formed or fixed by fasteners. In this case, the compensation assembly may only compensate relative rotation between the combustion chamber and the resonator cavity by means of the bulb portion of the neck tube and the socket portion of the compensation assembly.

It should also be noticed that, in another applications where relative rotation and relative movement need to be compensated simultaneously, the sliding part pairs, i.e. the first and second sliding part, the third and fourth sliding part may be utilized both or either pair of them, in combination with the bulb portion of the neck tube and the socket portion of the compensation assembly. Those skilled in the art will appreciate proper combinations of the compensation structures to achieve desired rotation and/or movement compensation.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A damper for reducing the pulsations in a combustion chamber of a gas turbine, the damper comprising:

a resonator cavity with an inlet and a neck tube in flow communication with the interior of the combustion chamber and resonator cavity, and a compensation assembly pivotably connected with the neck tube and inserted between the resonator cavity and the combustion chamber to permit relative movement between the combustion chamber and the resonator cavity in three axes.

2. The damper according to claim 1, wherein, the neck tube is air-tightly attached at a first end thereof to a wall of the combustion chamber, the compensation assembly is pivotably connected with a second end of the tube neck, and the compensation assembly comprises a bulb portion formed on the second end of the neck tube and a socket portion air-tightly fitted with the bulb portion to provide a relative rotation between the combustion chamber and the resonator cavity.

3. The damper according to claim 1, wherein, the compensation assembly comprises a first sliding part formed on the socket portion and a second sliding part air-tightly fitted with the first sliding part to provide relative sliding movement along a direction parallel to a longitudinal axis of the neck tube between the first sliding part and the second sliding part.

4. The damper according to claim 3, wherein, the compensation assembly comprises a third sliding part formed on the second sliding part and a fourth sliding part formed on the inlet of the resonator cavity that is air-tightly fitted with the third sliding part to provide relative sliding movement in a direction orthogonal to the longitudinal axis of the neck tube between the third sliding part and the fourth sliding part.

5. The damper according to claim 1, wherein, the wall of the combustion chamber comprises an inner wall and an outer wall radially located outward than the inner wall, and the neck tube is air-tightly attached at the first end thereof to the inner wall of the combustion chamber, and extending through an opening on the outer wall with a grommet air-tightly attached to a peripheral of the neck tube in order to cover a gap generated between the neck tube and the opening.

6. The damper according to claim 4, wherein, the third sliding part comprises a protrusion formed thereon where the protrusion is allowed to air-tightly slide against the fourth sliding part.

7. The damper according to claim 3, wherein, the neck tube is air-tightly attached at a first end thereof to the inlet of the resonator cavity, the compensation assembly is pivotably connected with a second end of the neck tube, and the compensation assembly comprises a bulb portion formed on the second end of the tube neck and a socket portion air-tightly fitted with the bulb portion to provide a relative rotation between the combustion chamber and the resonator cavity.

8. The damper according to claim 5, wherein, the compensation assembly comprises a first sliding part formed on the socket portion and a second sliding part air-tightly fitted with the first sliding part to provide relative sliding movement along a direction parallel to a longitudinal axis of the neck tube between the first sliding part and the second sliding part.

9. The damper according to claim 7, wherein, the compensation assembly comprises a third sliding part formed on the second sliding part and a fourth sliding part formed on the wall of the combustion chamber that is air-tightly fitted with the third sliding part to provide relative sliding movement in a direction traversing the longitudinal axis of the neck tube between the third sliding part and the fourth sliding part.

10. The damper according to claim 9, wherein, the third sliding part comprises a protrusion formed thereon where the protrusion is allowed to air-tightly slide against the fourth sliding part.

* * * * *